US005794993A

United States Patent [19]

Eckerdt

[11] Patent Number: 5,794,993

[45] Date of Patent: Aug. 18, 1998

[54] TAMPER-EVIDENT RING

[75] Inventor: George H. Eckerdt, Rochester, N.Y.

[73] Assignee: Key Systems, Inc., Rochester, N.Y.

[21] Appl. No.: 801,553

[22] Filed: Feb. 18, 1997

Related U.S. Application Data

[63] Continuation of Ser. No. 387,279, Feb. 13, 1995, abandoned.

[51] Int. Cl.[6] ..... B65D 27/30

[52] U.S. Cl. ..... 292/307 R; 70/458

[58] Field of Search ..... 292/315, 316, 292/317, 318, 319, 321, 307 A; 70/456 R, 457, 458, 459, 465; 24/704.1, 704.2, 16 PB, 662

[56] References Cited

U.S. PATENT DOCUMENTS

| | | | |
|---|---|---|---|
| 66,244 | 7/1867 | Moulton . | |
| 250,195 | 11/1881 | Booraem | 70/458 |
| 765,823 | 7/1904 | Erb | 70/456 R |
| 766,754 | 7/1904 | Siresdorfer | 70/456 R |
| 1,132,970 | 3/1915 | Peyton . | |
| 1,139,556 | 5/1915 | Mitten | 292/307 R |
| 1,172,374 | 2/1916 | Leimer | 70/459 |
| 1,435,347 | 11/1922 | Taylor . | |
| 1,526,498 | 2/1925 | Jung | 70/458 |
| 1,682,396 | 8/1928 | Miller | 292/307 R |
| 1,792,575 | 2/1931 | D'Ewart | 292/307 R |
| 2,227,569 | 1/1941 | Brooks | 292/315 |
| 2,432,870 | 12/1947 | Evalt . | |
| 2,771,768 | 11/1956 | Tudor | 70/457 |
| 3,237,977 | 3/1966 | Batchelder . | |
| 3,481,169 | 12/1969 | Rossi | 70/456 R |
| 3,852,982 | 12/1974 | Faris | 70/457 |
| 4,224,815 | 9/1980 | Aiken . | |
| 4,500,124 | 2/1985 | Swift . | |
| 4,733,893 | 3/1988 | Davis et al. . | |
| 4,782,564 | 11/1988 | Sloan . | |
| 4,893,853 | 1/1990 | Guiler . | |
| 4,929,006 | 5/1990 | Tsay | 292/319 |
| 4,991,889 | 2/1991 | Remark | 292/331 |
| 5,138,855 | 8/1992 | Faris . | |
| 5,226,809 | 7/1993 | Franco . | |
| 5,293,668 | 3/1994 | Tibiletti . | |

FOREIGN PATENT DOCUMENTS

| | | | |
|---|---|---|---|
| 437682 | 11/1935 | European Pat. Off. | 70/458 |

*Primary Examiner*—Steven N. Meyers
*Assistant Examiner*—Gary Estremsky
*Attorney, Agent, or Firm*—Eugene Stephens & Associates

[57] ABSTRACT

A tamper-evident ring is made from a split ring made of a strong resilient material and terminated by male and female fittings. The two fittings can be connected to form a continuous ring of the type that allows keys to slide entirely around the ring. One of the two fittings is breakable to prevent the ring from being reclosed and to provide a visual indication that the ring has been reopened.

10 Claims, 3 Drawing Sheets

TAMPER-EVIDENT RING

RELATED APPLICATIONS

This application is a Continuation of parent application Ser. No. 08/387,279, filed 13 Feb. 1995, entitled TAMPER-EVIDENT RING, and abandoned upon the filing of this Continuation application.

FIELD OF INVENTION

The invention relates to tamper-evident rings, such as seals and key rings that incorporate security features to inhibit undetected opening or reclosing of the rings.

BACKGROUND

Key rings are commonplace, and most such rings are arranged for keys to be routinely removed or replaced from the rings. However, in high security areas such as jails, a closer accounting of keys is necessary to prevent unauthorized use or copying of the keys. Accordingly, some security key rings are arranged for permanently mounting keys on continuous key rings to prevent their removal or replacement.

For example, security key rings have been fashioned from stainless steel bar stock having a standard cross-sectional diameter of approximately four millimeters to accommodate openings in most keys. The bar stock is bent in the form of a split ring, and keys are mounted on the ring. The split ring is then welded closed to form a continuous ring, which must be cut apart to remove any keys. However, the welded joint increases the cross-sectional diameter of the ring and adds significant cost and time to the assembly of the key rings.

U.S. Pat. No. 2,432,870 to Evalt discloses a continuous key ring made of plastic. A helical segment of the plastic is formed with two mating ends. After mounting a key and a tag, the mating ends are aligned and a solvent is applied to form a fusion weld at the joint. The plastic ring can be easily severed for separating the key and tag, and another plastic ring can be used for linking the key to a different tag. However, such plastic rings are not strong enough to be used in high security areas, where continuous key rings are required to hold more keys and to prevent the keys from being easily removed.

While it is important to structurally inhibit the removal of keys by using strong materials, their removal cannot be entirely prevented, so it is also important to detect their removal or replacement. Both the plastic ring of Evalt and the stainless steel security rings currently in use can be rewelded closed without any signs that they had been opened.

A variety of tamper-evident designs for locks and other security devices are known, but none are suitable for use with continuous key rings that have a limited cross-sectional dimension. For example, U.S. Pat. No. 4,893,853 to Guiler discloses a tamper-evident padlock in which forced attempts to remove a shackle from the padlock body cause shackle ends to rupture the padlock body. U.S. Pat. No. 4,782,564 to Sloan discloses a safety release pin for a fire extinguisher that, upon removal, fractures a locking mechanism to provide a visual indication that the device has been used. Neither of these tamper-evident designs could be used within the confines of a continuous key ring.

SUMMARY OF INVENTION

My invention provides for incorporating tamper-evident features into continuous rings. A single-use interlock combines a seal with a high strength connector for joining ends of a split ring into a continuous ring that cannot be reopened without breaking the interlock. This prevents the continuous ring from being reclosed and provides a visual indication that the ring has been reopened.

One example of my invention includes a split ring that is made from a strong resilient material, such as stainless steel, having a given maximum cross-sectional diameter for mounting security keys. A male fitting is formed at one end of the split ring, and a female fitting is formed at the other end of the split ring. The male and female fittings interconnect to form a joint that has a cross-sectional diameter no larger than the maximum cross-sectional diameter of the split ring. One of the fittings is breakable for disconnecting the two fittings and for preventing the fittings from being reconnected.

The male fitting has head and neck portions, and the female fitting has a socket portion. The two fittings are joined within a region of overlap by crimping the socket portion of the female fitting over the head portion of the male fitting. A hardened wheel of a crimping tool forms an annular indentation that is pressed toward the neck portion of the male fitting adjacent to the head portion of the same fitting. The indentation weakens the socket portion and renders the socket portion susceptible to breakage if force is used to separate the two fittings. The broken socket cannot be reused to interconnect the two ends of the split ring. The breakage is also readily observable as evidence of tampering.

Another example of my invention modifies the socket to capture a snap-ring, which can be contracted for insertion past detents at the open end of the socket. The head portion of the male fitting is beveled to temporarily expand the snap-ring until the snap-ring has sprung in place around the neck portion of the male fitting. The two fittings cannot be separated without breaking one of the fittings.

DRAWINGS

DETAILED DESCRIPTION

Figure 1:
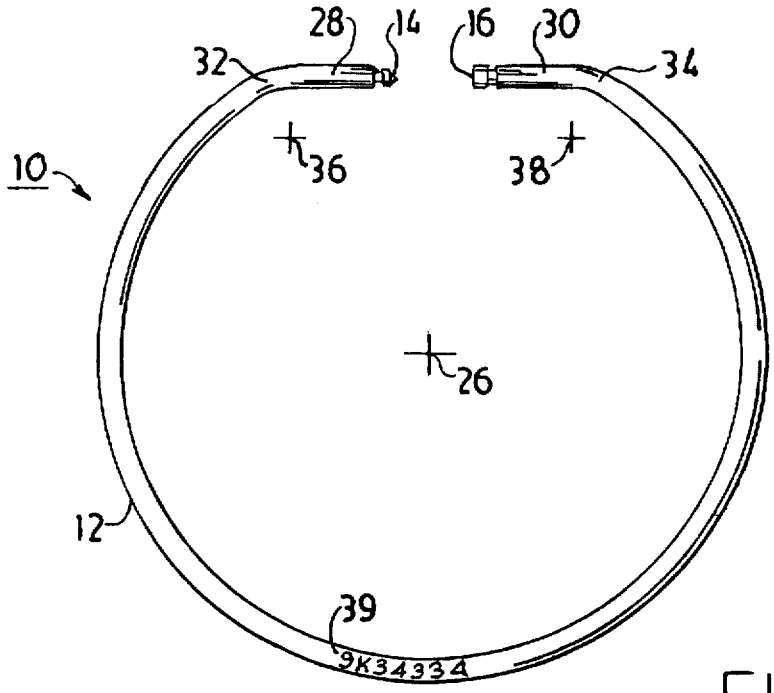
FIG. 1 is a plan view of one example of my new tamper-evident key ring.
Figure 2:
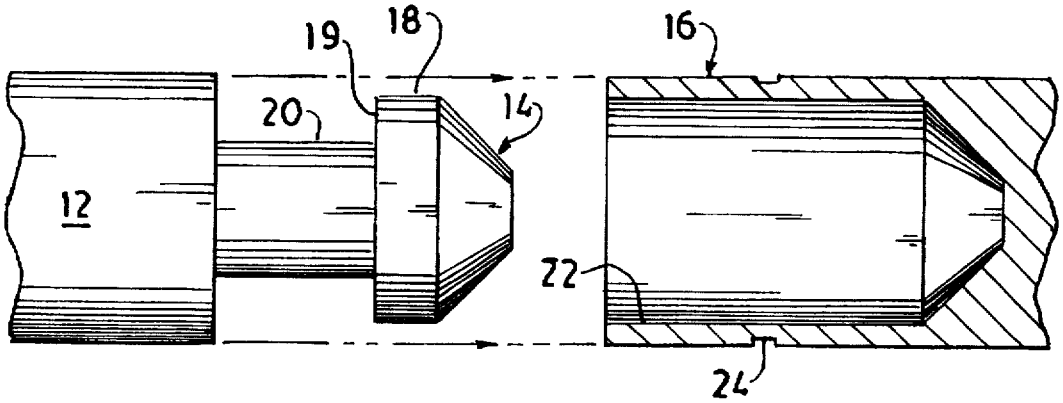
FIG. 2 is an enlarged view of male and female fittings at open ends of the key ring with the female fitting shown in cross section.
Figure 3:
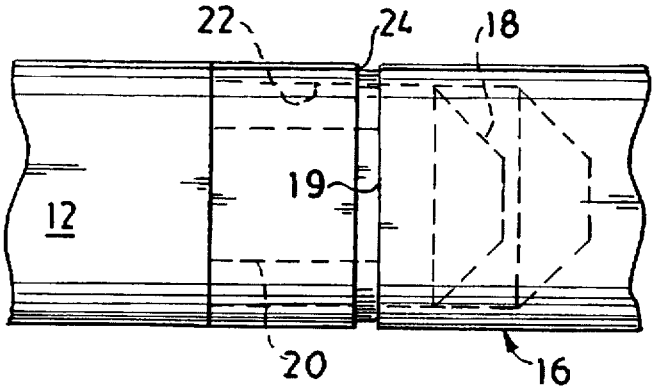
FIG. 3 is a similarly enlarged view of the male and female fittings closed together.

A preferred embodiment of my invention is a tamper-evident key ring 10 as shown in FIGS. 1–3. The key ring 10 has a split-ring body 12 that is preferably made from a strong resilient material such as stainless steel. Some softer materials could also be used, but I prefer these to exhibit ultimate tensile strength of at least 100 megapascals. Also, the split-ring body 12 preferably has a constant cross-sectional diameter no more than 6 millimeters; and in most instances, the cross-sectional diameter should be 4 millimeters.

A male fitting 14 is formed at one end of the split-ring body 12, and a female fitting 16 is formed at the other end of the split-ring body 12. The male fitting 14 has a head portion 18 that is supported from the split-ring body 12 by a narrower neck portion 20. As shown best in FIG. 2, the head portion 18 is joined to the neck portion 20 by a ledge 19 that forms a right-angle interface making a sheer diametrical variation between the head and neck portions 18 and 20. The female fitting 16 has a socket portion 22 that is sized for encompassing the head and neck portions 18 and 20 of the male fitting 14. A periphery of the female fitting 16 is encircled by a groove 24 for guiding a crimping tool 56 (see FIGS. 5 and 6). The groove 24 is aligned with a junction where the head portion 18 meets the neck portion 20 of the male fitting 14 when the two fittings 14 and 16 are closed together.

Most of the split-ring body 12 is bent at a single curvature having a center of curvature 26. However, the split-ring body 12 also includes straight sections 28 and 30 that are adjacent to the male and female fittings 14 and 16. The two straight sections 28 and 30 are connected to the remaining portion of the split-ring body 12 by more abruptly curved sections 32 and 34 having centers of curvature 36 and 38. The two more abruptly curved sections 32 and 34 provide for aligning the two straight sections 28 and 30 when the two fittings 14 and 16 are closed together. A laser-etched serial number 39 distinguishes each split-ring body 12 to prevent substitutions.

Figure 4:
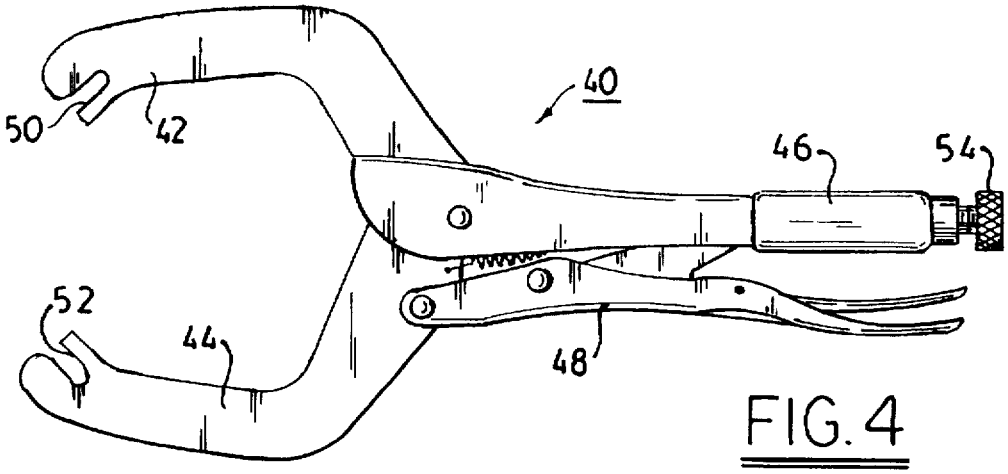
FIG. 4 is a plan view of a pair of vise grips for squeezing the key ring.
Figure 5:
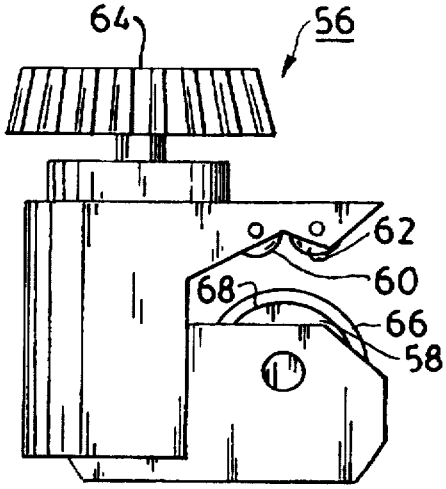
FIG. 5 is a side view of a crimping tool for joining the male and female fittings.
Figure 6:
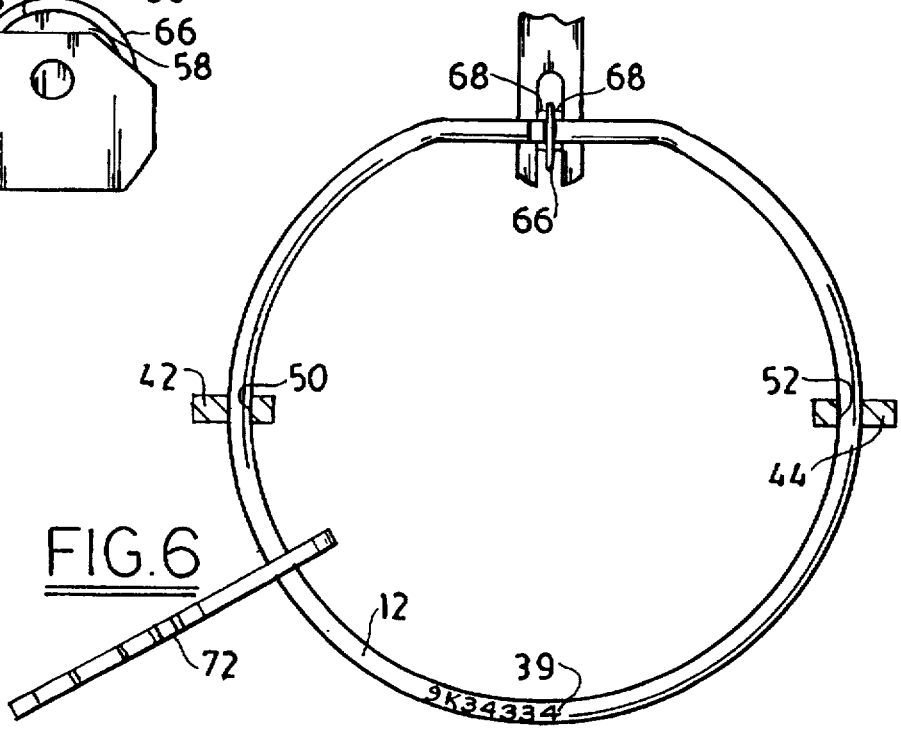
FIG. 6 is a plan view of the closed ring showing positions at which the vise grips and crimping tool engage the ring.

FIGS. 4–6 show tooling for crimping the male and female fittings 14 and 16 together. An adjustable pair of vise grips 40 are shown in FIG. 4. The vise grips 40 include two specialized jaws 42 and 44 that are adjustably supported by conventional handles 46 and 48. Slots 50 and 52 in ends of the jaws 42 and 44 are sized for gripping opposite sides of the split ring 12. Set screw 54 adjusts a minimum spacing between the jaws 42 and 44 for closing the split ring 12 as shown in FIGS. 3 and 6.

A crimping tool 56 for joining the male and female fittings 14 and 16 within a region of overlap is shown in FIG. 5. The female fitting 16 is engaged between a hardened wheel 58 and two rollers 60 and 62. Pressure between the hardened wheel 58 and the female fitting 16 is applied by a screw 64 that adjusts spacing between the hardened wheel 58 and the two rollers 60 and 62. A raised ridge 66 of the hardened wheel 58 tracks along the groove 24 while the crimping tool 56 is rotated around the female fitting 16. While continuing to rotate under pressure, the hardened wheel 58 swages a ring of material from the socket portion 22 of the female fitting 16 toward the neck portion 20 and against the ledge 19 of the male fitting 14 until shoulders 68 of the hardened wheel 58 contact the female fitting 16. A mechanical stop could also be used to limit penetration of the hardened wheel 58.

Although the annular crimp forms a strong bond between the male and female fittings 14 and 16, the swaged material forming the crimp is further hardened and made more brittle than the remaining material of the key ring 10. Also, the deepened groove 24 concentrates stress forces so that the female fitting 16 is fractured into two parts by unauthorized separation of the male and female fittings 14 and 16. Once fractured, the female fitting 16 can not be rejoined with the male fitting 14. The fractured fitting also provides a clear visual indication that the ring 10 has been reopened.

Figure 7:
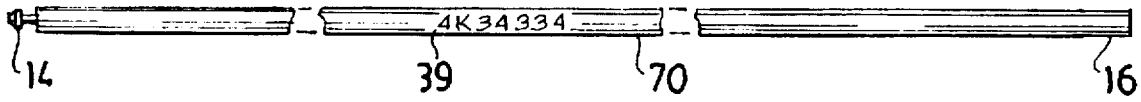
FIG. 7 is a plan view of round bar stock that is machined at opposite ends to form the male and female fittings.

The illustrated key ring 10 can be made from a round bar stock 70 (see FIG. 7) having a constant cross-sectional diameter. The bar stock 70 is cut to a given length. The male fitting 14 is formed at one end of the length, and the female fitting 16 is formed at the other end of the length. The head and neck portions 18 and 20 of the male fitting 14 are preferably machined in a turning operation. The socket portion 22 of the female fitting 16 is preferably bored. The groove 24 in the female fitting 16 can also be formed by turning. Thereafter, the bar stock is bent to form the split-ring body 12 as depicted in FIG. 1.

One or more keys 72 can be mounted on the split-ring body 12 by passing one of the two fittings 14 and 16 through respective openings in the keys 72. The two fittings 14 and 16 are squeezed together by the vise grips 40 against a restorative force of the split-ring body 12 so that the head and neck portions 18 and 20 of the male fitting are inserted into the socket portion 22 of the female fitting (see FIG. 6). The crimping tool 56 is mounted on the straight sections 28 and 30 of the split-ring body 12, and the raised ridge 66 of the hardened wheel 58 is aligned with the groove 24 in the female fitting 16. The screw 64 of the crimping tool 56 is turned to apply pressure while the crimping tool 56 is rotated to seal the male and female fittings 14 and 16 together. After the vise grips 40 and the crimping tool 56 are removed, the keys 72 can slide 360 degrees around the key ring 10.

Figure 8:
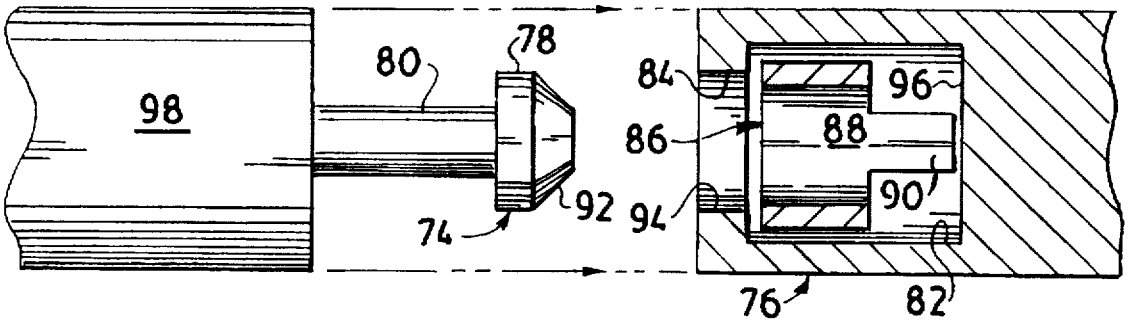
FIG. 8 is an enlarged view of an alternative pair of male and female fittings with the female fitting shown in cross section.
Figure 9:
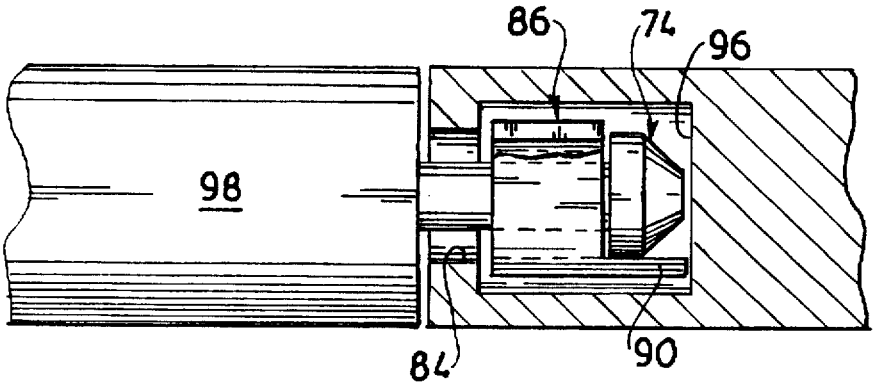
FIG. 9 is a similarly enlarged view of the alternative fittings closed together.
Figure 10:
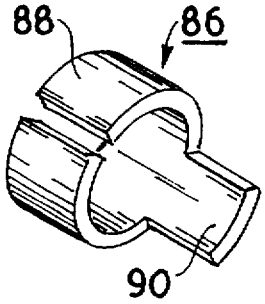
FIG. 10 is an isometric view of a snap-ring for interconnecting the alternative pair of male and female fittings.

The remaining drawing FIGS. 8–10 illustrate alternative male and female fittings 74 and 76 for sealing opposite ends of a split-ring body 98. Similar to the preceding embodiment, the male fitting 74 includes head and neck portions 78 and 80, and the female fitting 76 includes a socket portion 82. However, the female fitting 76 also includes a detent 84 that is formed as an annular lip at an open end 94 of the socket portion 82. The head portion 78 of the male fitting 74 is relatively sized to fit through the detent 84 into the socket portion 82 of the female fitting 76.

The male and female fittings 74 and 76 are held together by a snap-ring 86 that is captured within the socket portion 82 of the female fitting 76 by the detent 84. The snap-ring 86 is made out of a brittle yet resilient material, such as hardened steel, and has a split-sleeve body 88 with a tab 90 that extends from one end. The split-sleeve body 88 can be temporarily compressed to fit the snap-ring 86 through the detent 84 into position within the socket portion 82 of the female fitting.

The head portion 78 of the male fitting has a beveled end face 92 for temporarily expanding the split-sleeve body 88 while the male fitting 74 is first inserted into the female fitting 76. The tab 90 spaces the split-sleeve body 88 from a closed end 96 of the socket portion 82 until the split-sleeve body 88 has sprung into place around the neck portion 80 of the male fitting. The split-sleeve body 88 of the snap-ring 86 captures the head portion 78 of the male fitting, and the detent 84 of the female fitting captures the split-sleeve body 88. Once joined, the male and female fittings 74 and 76 cannot be separated without breaking.

Although my tamper-evident ring has been described for use as a key ring, a variety of other uses will also be apparent to those of skill in this art. For example, my ring could be used as a seal for cargo doors of trucks and trains or for other locks, closures, or connections requiring protection from tampering.

I claim:

1. A tamper-evident key ring comprising:

a split ring permanently bent into an annular shape and having a constant cross-sectional diameter along a length between first and second ends and means for securing said first and second ends by crimping comprising;

a male fitting formed at said first end;

an axially symmetric female fitting formed at said second end;

said split ring together with said male and female fittings forming a single undivided body fashioned from a single piece of material;

said male and female fittings being interconnectable for forming a joint having a cross-sectional diameter no larger than said constant cross-sectional diameter of the split ring;

said male fitting having an enlarged head portion joined to said first end through a narrowed neck portion;

said female fitting including a socket portion that is sized for encompassing said head and neck portions of the male fitting said male and female fittings being sized for freely sliding in an overlap relationship prior to being crimped;

said enlarged head portion being joined to said narrowed neck portion with a ledge that forms a right-angle interface between said head and neck portions;

said male and female fittings being engageable by a crimp formed in said female fitting engaging said ledge formed in the male fitting and together forming a permanent connection preventing said male and female fittings from being pulled apart along said length of the ring;

said engagement between said male and female fittings also preventing said male and female fittings from being pulled apart along said length of the ring without a detectable change to one of said fittings; and said female fitting being encircled by a groove for guiding a crimping tool.

2. A tamper-evident key ring comprising:

a split ring permanently bent into an annular shape and having a constant cross-sectional diameter along a length between first and second ends and means for securing said first and second ends by crimping comprising;

a male fitting formed at said first end;

an axially symmetric female fitting formed at said second end;

said split ring together with said male and female fittings forming a single undivided body fashioned from a single piece of material;

said male and female fittings being interconnectable for forming a joint having a cross-sectional diameter no larger than said constant cross-sectional diameter of the split ring;

said male fitting having an enlarged head portion joined to said first end through a narrowed neck portion;

said female fitting including a socket portion that is sized for encompassing said head and neck portions of the male fitting said male and female fittings being sized for freely sliding in an overlap relationship prior to being crimped;

said enlarged head portion being joined to said narrowed neck portion with a ledge that makes a sheer diametrical transition between said head and neck portions; and a full circumferential indentation formed in said female fitting engaging said ledge formed in the male fitting and together forming a permanent connection that prevents said male and female fittings from being taken apart without a detectable change to one of said fittings.

3. The ring of claim 2 in which said split ring is generally curved but has straight sections adjacent to said two ends.

4. A tamper-evident key ring comprising:

a split-ring body made of a single piece of resilient material having an ultimate tensile strength of at least 100 megapascals and permanently bent into an annular shape;

said split-ring body having a round cross-sectional shape throughout its length and a constant cross-sectional diameter no greater than 6 millimeters;

two ends of said split-ring body including within said single piece means for securing said ends by crimping, said means comprising respective male and female fittings that can be joined together forming a region of overlap that also has a cross-sectional diameter no greater than 6millimeters;

said male fitting having an enlarged head portion joined to said first end through a narrowed neck portion;

said female fitting being axially symmetric and including a socket portion that is sized for encompassing said head and neck portions of the male fitting said male and female fittings being sized for freely sliding in and out of said region of overlap prior to being crimped;

said enlarged head portion being joined to said narrowed neck portion with a ledge that makes a sheer diametrical transition between said head and neck portions;

said male and female fittings being.engageable by a crimp formed in said female fitting engaging said ledge formed in the male fitting and together forming a permanent connection preventing said male and female fittings from being pulled apart along said length of the ring;

said engagement between said male and female fittings also preventing said male and female fittings from being pulled apart along said length of the ring without a detectable change to one of said fittings;

said fittings being shaped to concentrate stresses within said region of overlap for reducing resistance to fracture with respect to the remaining portion of the split-ring body; and said female fitting being encircled by a groove within said region of overlap.

5. The key ring of claim 4 further comprising a circumferential indentation formed along said groove for crimping said male and female fittings together.

6. A tamper-evident key ring comprising:

a split-ring body made of a single piece of resilient material having an ultimate tensile strength of at least 100 megapascals and permanently bent into an annular shape;

said split-ring body having a round cross-sectional shape throughout its length and a constant cross-sectional diameter no greater than 6 millimeters;

two ends of said split-ring body including within said single piece means for securing said ends by crimping, said means comprising; respective male and female fittings that can be joined together forming a region of overlap that also has a cross-sectional diameter no greater than 6 millimeters;

said male fitting having an enlarged head portion joined to said first end through a narrowed neck portion;

said female fitting being axially symmetric and including a socket portion that is sized for encompassing said head and neck portions of the male fitting said male and female fittings being sized for freely sliding in and out of engagement defined by said region of overlap prior to being crimped;

said enlarged head portion being joined to said narrowed neck portion with a ledge that makes a sheer diametrical transition between said head and neck portions; and a full circumferential indentation in said socket portion of the female fitting engaging said ledge formed in the male fitting and together forming a permanent connection that prevents said male and female fittings from being taken apart without a detectable change to one of said fittings.

7. The key ring of claim 6 in which said circumferential indentation extends along the entire circumference of said socket portion for crimping the two fittings together.

8. A method of fixing a key on a tamper-evident key ring of the type that allows keys to slide 360 degrees around the ring comprising the steps of:

mounting a key on a single piece torsionally rigid key ring having a constant cross-sectional diameter throughout its length and a single body including two ends by passing one of the two ends of the key ring through an opening in the key;

inserting one of the two ends having a head portion supported from a neck portion into the other of the two ends having a socket portion to form a joint having a cross-sectional diameter no larger than the constant cross-sectional diameter of the key ring;

making a circumferential indentation in the socket portion after inserting the head portion of one end into the socket portion of the other end; and pressing the indentation toward the neck portion and against a ledge forming a sheer diametrical transition between the head and neck portions for preventing the two ends from being pulled apart along the length of the ring and for sealing the two ends of the key ring together so that one of said two ends is damaged by subsequent separation of the two ends.

9. The method of claim 8 including the further step of squeezing the two ends of the key ring together against a resilient restorative force of the key ring prior to said step of inserting.

10. The method of claim 8 in which the circumferential indentation is made around an entire circumference of the socket portion.

* * * * *